US007311605B2

(12) United States Patent
Moser

(10) Patent No.: US 7,311,605 B2
(45) Date of Patent: Dec. 25, 2007

(54) PLAYER TRACKING ASSEMBLY FOR COMPLETE PATRON TRACKING FOR BOTH GAMING AND NON-GAMING CASINO ACTIVITY

(75) Inventor: Timothy W. Moser, Las Vegas, NV (US)

(73) Assignee: IGT, Reno, NV (US)

( * ) Notice: Subject to any disclaimer, the term of this patent is extended or adjusted under 35 U.S.C. 154(b) by 219 days.

(21) Appl. No.: 10/170,278

(22) Filed: Jun. 12, 2002

(65) Prior Publication Data

US 2003/0232647 A1 Dec. 18, 2003

(51) Int. Cl.
*A63F 9/24* (2006.01)

(52) U.S. Cl. ..... 463/25; 463/42

(58) Field of Classification Search ..... 463/12–13, 463/16–22, 25–29, 40–42, 39; 235/375–382; 340/572.1–572.4, 323 R; 342/27–28, 42–44; 700/91–93; 273/143 R, 309, 292–293, 236–237, 273/459–460

See application file for complete search history.

(56) References Cited

U.S. PATENT DOCUMENTS

| | | | |
|---|---|---|---|
| 4,669,730 | A | 6/1987 | Small |
| 4,856,787 | A | 8/1989 | Itkis |
| 5,129,652 | A | 7/1992 | Wilkinson |
| 5,265,874 | A | 11/1993 | Dickinson et al. |
| 5,318,298 | A | 6/1994 | Kelly et al. |
| 5,321,241 | A | 6/1994 | Craine |
| 5,326,104 | A | 7/1994 | Pease et al. |
| 5,373,440 | A | 12/1994 | Cohen et al. |
| 5,557,086 | A | 9/1996 | Schulze et al. |

(Continued)

FOREIGN PATENT DOCUMENTS

| | | |
|---|---|---|
| EP | 0360613 | 4/1995 |

(Continued)

OTHER PUBLICATIONS

Electronics Now, Whats News, 'In-Charge Cards', Aug. 1993, p. 4.*

EPO Application No. 03 760 364.4-2221, Communication regarding Examination, dated May 20, 2005.

EP patent application No. 03760364.4-2221, Preliminary Opinion dated May 10, 2006.

*Primary Examiner*—Mark Sager
(74) *Attorney, Agent, or Firm*—Beyer Weaver LLP.

(57) ABSTRACT

A player tracking system for tracking customer activity for a casino establishment having gaming sections and non-gaming sections. The player tracking system includes a plurality of player tracking cards for distribution to respective participating customers that incorporate respective customer accounts associated with respective customer IDs. The system further includes a plurality of gaming activity player tracking units positioned in the gaming section of the casino establishment proximate the gaming activity which cooperates with the player tracking cards to monitor the gaming activity data of the respective customer, and a plurality of non-gaming activity player tracking units positioned in the non-gaming section of the casino establishment proximate the non-gaming activity which cooperates with the player tracking cards to monitor the non-gaming activity data of the respective customer. A computer system includes a database of the respective customer accounts associated with respective customer Ids, and each gaming activity player tracking unit and each non-gaming activity player tracking unit coupled to the computer system to process the respective gaming activity data and non-gaming activity data for each respective customer.

20 Claims, 3 Drawing Sheets

U.S. PATENT DOCUMENTS 5,581,257 A * 12/1996 Greene et al. ..... 342/51
5,643,086 A 7/1997 Alcorn et al.
5,655,961 A 8/1997 Acres et al.
5,702,304 A 12/1997 Acres et al.
5,722,891 A 3/1998 Inoue
5,741,183 A 4/1998 Acres et al.
5,741,184 A * 4/1998 Takemoto et al. ..... 463/43
5,743,798 A 4/1998 Adams et al.
5,752,882 A 5/1998 Acres et al.
5,761,647 A 6/1998 Boushy
5,768,382 A 6/1998 Schneier et al.
5,770,533 A 6/1998 Franchi
5,820,459 A 10/1998 Acres et al.
5,836,817 A 11/1998 Acres et al.
5,871,398 A 2/1999 Schneier et al.
5,876,284 A 3/1999 Acres et al.
5,892,661 A * 4/1999 Stafford et al. ..... 361/737
5,967,896 A 10/1999 Jorasch et al.
5,977,913 A 11/1999 Christ
6,003,013 A 12/1999 Boushy et al.
6,019,283 A 2/2000 Lucero
6,048,271 A 4/2000 Barcelou
6,104,815 A 8/2000 Alcorn et al.
6,106,396 A 8/2000 Alcorn et al.
6,149,522 A 11/2000 Alcorn et al.
6,162,122 A 12/2000 Acres et al.
6,165,071 A 12/2000 Weiss
6,183,362 B1 2/2001 Boushy
6,234,900 B1 5/2001 Cumbers
6,254,006 B1 7/2001 Mish
6,254,483 B1 7/2001 Acres
6,400,272 B1 * 6/2002 Holtzman et al. ..... 340/572.1
6,409,595 B1 6/2002 Uihlein et al.
6,431,983 B2 8/2002 Acres
6,554,705 B1 * 4/2003 Cumbers ..... 463/29
7,025,674 B2 * 4/2006 Adams et al. ..... 463/1
2002/0034978 A1 3/2002 Legge et al.

FOREIGN PATENT DOCUMENTS

EP 0762341 12/1997
EP 1096438 5/2001
EP 1139310 10/2001
WO WO95/24689 9/1995
WO WO96/00950 1/1996
WO WO98/12648 3/1998
WO WO 00/52655 8/2000
WO WO 00/78419 12/2000

* cited by examiner

PLAYER TRACKING ASSEMBLY FOR COMPLETE PATRON TRACKING FOR BOTH GAMING AND NON-GAMING CASINO ACTIVITY

BACKGROUND OF THE INVENTION

The present invention relates generally to player tracking services one gaming machines, and more particularly, relates to complete patron tracking of all casino activity.

There are a wide variety of associated devices that can be connected to a gaming machine such as a slot machine or video poker machine. Some examples of these devices are player tracking units, lights, ticket printers, card readers, speakers, bill validators, ticket readers, coin acceptors, display panels, key pads, coin hoppers and button pads. Many of these devices are built into the gaming machine or components associated with the gaming machine such as a top box which usually sits on top of the gaming machine.

Typically, utilizing a master gaming controller, the gaming machine controls various combinations of devices that allow a player to play a game on the gaming machine and also encourage game play on the gaming machine. For example, a game played on a gaming machine usually requires a player to input money or indicia of credit into the gaming machine, indicate a wager amount, and initiate a game play. These steps require the gaming machine to control input devices, including bill validators and coin acceptors, to accept money into the gaming machine and recognize user inputs from devices, including touch screens and button pads, to determine the wager amount and initiate game play.

After game play has been initiated, the gaming machine determines a game outcome, presents the game outcome to the player and may dispense an award of some type depending on the outcome of the game. A game outcome presentation may utilize many different visual and audio components such as flashing lights, music, sounds and graphics. The visual and audio components of the game outcome presentation may be used to draw a players attention to various game features and to heighten the players interest in additional game play. Maintaining a game player's interest in game play, such as on a gaming machine or during other gaming activities, is an important consideration for an operator of a gaming establishment.

One related method of attaining and/or maintaining a game player's interest in game play are player tracking programs which are offered at various casinos. Player tracking programs provide rewards to players that typically correspond to the player's level of patronage (e.g., to the player's playing frequency and/or total amount of game plays at a given casino). Player tracking rewards may include free meals, free lodging and/or free entertainment. These rewards may help to sustain a game player's interest in additional game play during a visit to a gaming establishment and may entice a player to visit a gaming establishment to partake in various gaming activities.

In general, player tracking programs may be applied to any game of chance offered at a gaming establishment. In particular, player tracking programs are very popular with players of mechanical slot gaming machines and video slot gaming machines. In a gaming machine, a player tracking program is implemented using a player tracking unit installed in the gaming machine and in communication with a remote player tracking server.

Due to their increasing popularity, player tracking cards and player tracking programs have essentially become the de facto marketing method of doing business at casinos. As suggested above, a player's incentive for using the player tracking services is awards provided by the gaming machine operator (e.g., the casino). Some incentives of a casino for providing player tracking services is to generate "brand" loyalty, gather valuable information that may be used for marketing and provide better customer services. This is due to the fact that the programs allow a casino to identify and reward customers based upon their previous game play history. In particular, a goal of the casinos is to identify and then to provide a higher level of service to certain groups of players identified as especially valuable to the casinos.

Gaming establishments are continually searching for new and innovative techniques to track patron activity to improve casino operations and marketing. Thus, while these current tracking systems are adequate, they are limited mainly to gaming play and Point-Of-Sales events. It would be desirable, accordingly, to provide an apparatus and method for player tracking programs that allow the casinos to expand such player tracking to include all casino activity.

SUMMARY OF THE INVENTION

The present invention provides a player tracking system for tracking customer activity for a casino establishment having gaming sections and non-gaming sections. The tracking system includes a plurality of player tracking cards adapted for distribution to respective participating customers of the tracking program. These cards include respective customer IDs which are associated with respective customer accounts. The system further includes a plurality of gaming activity player tracking units positioned in the gaming section of the casino establishment proximate the gaming activity. These activity player tracking units cooperate with the player tracking cards to monitor the gaming activity data of the respective customer. A plurality of non-gaming activity player tracking units are also positioned about the casino establishment in the non-gaming sections thereof which cooperate with the player tracking cards to monitor the non-gaming activity data of the respective customer. A computer system of the player tracking system includes a database of the respective customer accounts associated with respective customer Ids. Each gaming activity player tracking unit and each non-gaming activity player tracking unit is coupled to the computer system to process the respective gaming activity data and non-gaming activity data for each respective customer.

Accordingly, not only is the gaming activity monitored, similar to current player tracking programs, but non-gaming activity is also monitored. Most notably, patron movement throughout the casino establishment is monitored which provides the establishment with a unique ability to maximize customer service and promotions to each customer based upon both the gaming activity data and non-gaming data.

In one specific embodiment, the non-gaming activity player tracking unit includes a wireless interface configured to detect the presence of a respective player tracking card in the local vicinity of the respective non-gaming section of the casino establishment. This device is preferably configured for placement proximate the entrances and exits of selected, respective non-gaming sections of the casino establishment. Thus, the non-gaming activity player tracking unit can detect when a respective customer enters and/or exits a particular respective non-gaming section, such as a casino restaurant, a casino shop, a casino theater, a casino bar or a casino showroom.

In another embodiment, the respective player tracking card is a Radio Frequency (RF) enabled smart card configured to generate an RF signal, and the wireless interface is a Radio Frequency (RF) receiver responsive to the RF signal.

In still another specific configuration, the computer system includes a management program which updates a theoretical win profile for the respective customer as a function of estimated winnings from the betting activity of the customer at the casino establishment over a time period.

In another aspect of the present invention, a method is included for tracking customer activity at a casino establishment having gaming sections and non-gaming sections, at a casino establishment having gaming sections and non-gaming sections. The method includes monitoring at least one gaming activity player tracking unit in the gaming section of the casino establishment for gaming activity data by a respective customer; and monitoring at least one non-gaming activity player tracking unit in the non-gaming section of the casino establishment for non-gaming activity data by the respective customer.

The monitoring the at least one gaming activity player tracking unit includes detecting the presence of a respective player tracking card in the local vicinity of the respective non-gaming section of the casino establishment through a wireless interface component of the non-gaming activity player tracking unit.

In another specific embodiment, the method includes placing the non-gaming activity player tracking unit proximate one of an entrance and an exit of a selected, respective non-gaming section of the casino establishment to detect one of the entrance and the exit of the respective customer into and out of the respective non-gaming section. The method may further include tracking patron movement of the respective customers in the non-gaming sections of the casino establishment through the non-gaming activity data, and periodically updating the patron movement of the respective customers in the casino establishment over a time period.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

DESCRIPTION OF THE PREFERRED EMBODIMENTS

Figure 1:
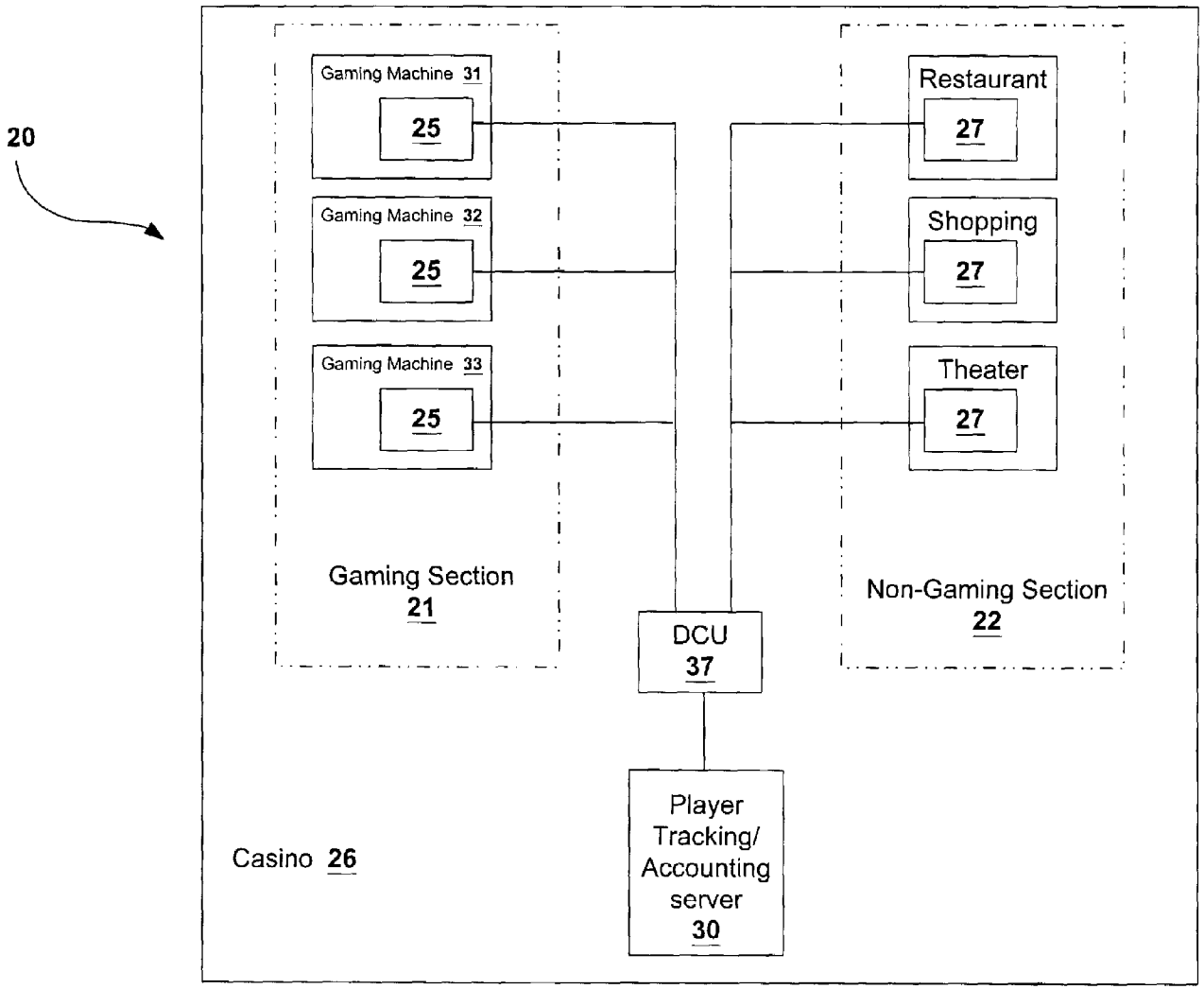
FIG. 1 is a block diagram of a player tracking system constructed in accordance with the present invention having gaming activity player tracking units and non-gaming activity player tracking units.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
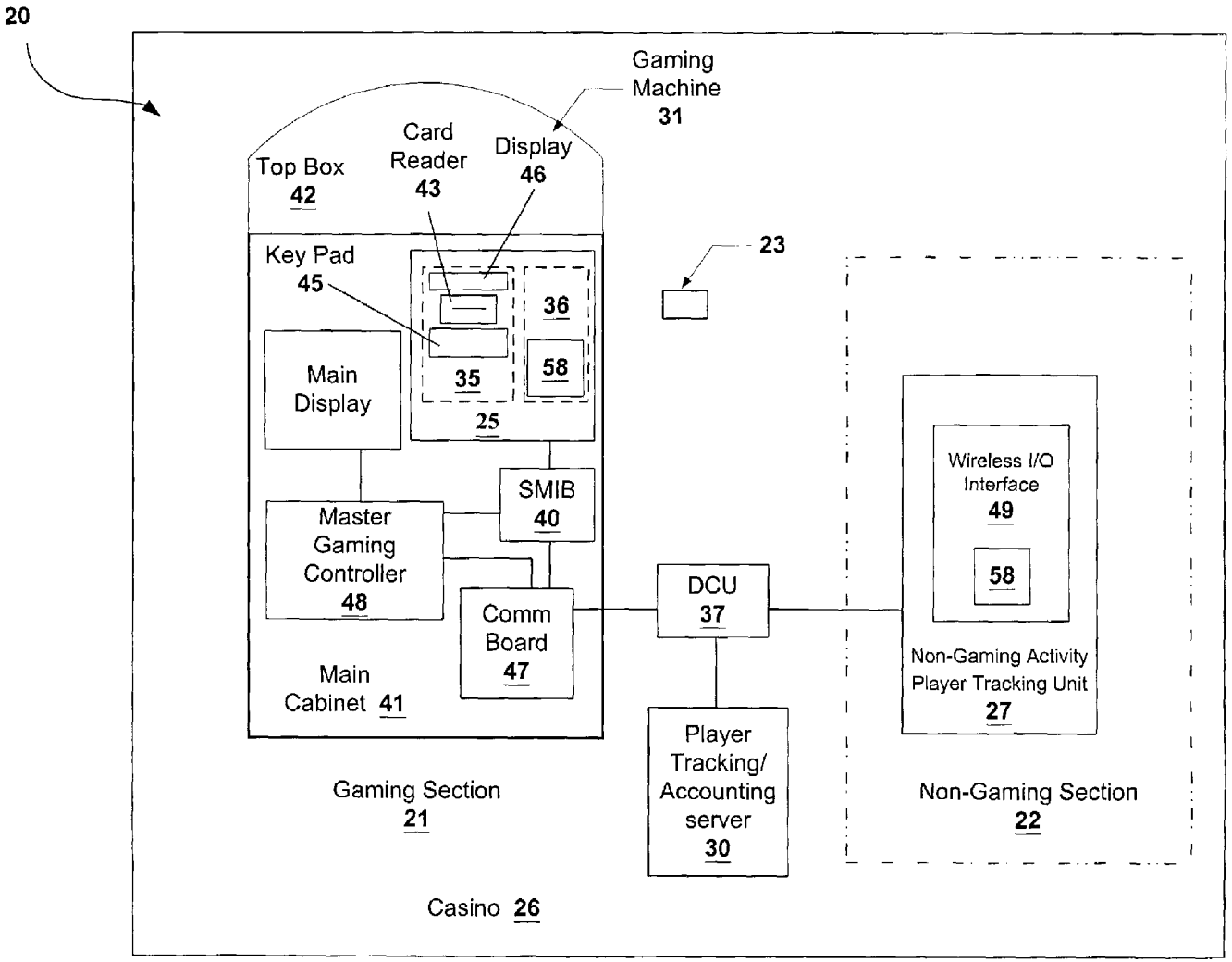
FIG. 2 is a block diagram of the components of the gaming activity player tracking unit and the non-gaming activity player tracking unit of player tracking system of FIG. 1.

Attention is now directed to FIGS. 1 and 2 where a player tracking system, generally designated 20, is illustrated for tracking customer activity for a casino establishment having gaming sections 21 and non-gaming sections 22. The tracking system 20 includes a plurality of player tracking identification devices 23 adapted for distribution to respective participating customers of the tracking program. These devices 23 include respective customer IDs which are associated with respective customer accounts. The system 20 further includes a plurality of gaming activity player tracking units 25 positioned in the gaming section 21 of the casino establishment 26. These activity player tracking units 25 cooperate with the player tracking identification devices 23 to monitor the gaming activity data of the respective customer. A plurality of non-gaming activity player tracking units 27 are also positioned about the casino establishment 26 in the non-gaming sections 22 thereof which cooperate with the player tracking identification devices 23 to monitor the non-gaming activity data of the respective customer. A computer system, generally designated 28, of the player tracking system 20 includes a database of the respective customer accounts associated with respective customer Ids. Each gaming activity player tracking unit 25 and each non-gaming activity player tracking unit 27 is coupled to the computer system 28 to process the respective gaming activity data and non-gaming activity data for each respective customer.

Accordingly, this tracking system would enable the casino establishment to monitor both gaming activity and non-gaming activity within the casino. The conventional monitoring of gaming activity is well known, and has been successfully applied throughout the industry. Extending such monitoring to other non-gaming activity, however, is relatively new, but may prove to be just as valuable to increase revenue. For example, the non-gaming activity player tracking units 27 can be adapted to monitor the entrance and/or the exit of the patron in the non-gaming section 22 of the casino establishment. Thus, one form of non-gaming activity monitoring would be the tracking of patron movement throughout the establishment in such non-gaming avenues of the casino as theater, shopping and restaurants. By recording the time of entrance and exit of a patron in a particular store or restaurant, the casino establishment can monitor and analyze their tendency to shop particular stores or frequent particular restaurants. Using the combined gaming activity data and non-gaming activity data, promotions and customer service programs can be more customized toward the respective customer monitored which enables the casino establishment to better customize promotional awards to the respective customer based upon their past attendance at the particular non-gaming sections.

By way of example, if the non-gaming activity data revealed that a particular patron frequently visited one of the many casino restaurants or shops more than another, future promotions could of that restaurant could be directed to that patron to entice future patronage. Moreover, other promotions from other casino restaurants or stores can be directed toward that respective customer to entice patronage at those the customer does not frequent. The ability for casinos to track the activity of card carrying patrons through their entire visit to casinos would provide the establishment with a tremendous increase in data for demographic study. Casinos, for instance, could better estimate how long it takes for a patron to begin gambling after they have entered the property. In other situations, the establishment could identify which restaurants, shops, etc. that card-carrying patrons more frequently visit even if they use cash for purchases. It would literally add another level to focusing casino operations and marketing on maximizing patron behaviors. In addition, it could add another level to customer service.

In still other applications, the player tracking system 20 could identify the participating patron through their player tracking identification device as they entered a restaurant or shop. A host or sales consultant could then approach and greet that patron by name, offer Comps or promotions to VIP's, know what products interest them, etc.

Referring to FIG. 1, the block diagram is provided which broadly illustrates the computer system 28 of the player tracking system 20 having a central player tracking/accounting server 30. The player tracking account server is typically configured to A) store player tracking account information relating to a player's previous game play, B) store player tracking account information relating to a player's historical frequency (E.g., the date and time spent) in the selected non-gaming sections of the casino, C) calculate player tracking points based on a player's game play that may be used as basis for providing rewards to the player; and D), calculate player tracking points and promotions based on a player's frequency at the selected non-gaming sections. The system is further defined, as mentioned, by a plurality of gaming activity player tracking units 25 to monitor the gaming activity data received from their corresponding gaming activity interfaces. This gaming activity component, as will be described, is essentially provided by conventional player tracking technology. Further coupled to the player tracking server, in accordance with the present invention, is a plurality of non-gaming activity player tracking units 27 which monitor the non-gaming activity data received from corresponding non-gaming activity interface positioned at the corresponding sections.

As mentioned, the present invention includes a conventional gaming activity component of the player tracking system similar to those currently in widespread application. Briefly, as illustrated in FIG. 1, the block diagram of a number of gaming machines with gaming activity player tracking units is illustrated connected to servers providing player tracking services. For example, in casino establishment 26, gaming machines 31, 32 and 33 are connected, via the data collection unit (DCU) 37 to the computer system or player tracking/accounting server 30. The DCU 37, which may be connected to up to thirty-two (32) gaming activity player tracking units as part of a local network in a particular example, consolidates the information gathered from player tracking units in gaming machines 31, 32 and 33 and forwards the information to the player tracking account server 30.

In gaming machine 31 of casino establishment 26, a gaming activity player tracking unit 25 and slot machine interface board (SMIB) 40 are mounted within a main cabinet 41 of the gaming machine. In many types of gaming machines, the player tracking unit is mounted within a top box 42 positioned stop the gaming machine cabinet 41. Usually, player tracking units, such as 25, and SMIBs, such as 40, are manufactured as separate units before installation into a gaming machine 31.

Typically, the gaming activity player tracking unit 25 includes three player tracking devices: a gaming activity card reader 43; a key pad 45; and a display 46, all mounted within the unit. These player tracking devices are associated with a wired Input/Output Interface 35, and are used to input player tracking information that is needed to implement the player tracking program. As will be described in greater detail below, the player tracking unit 25 may include a wireless Input/Output Interface 36 as well. The gaming activity component of player tracking system 20 may be mounted in many different arrangements depending upon design constraints such as accessibility to the player, packaging constraints of a gaming machine and a configuration of a gaming machine. For instance, the player tracking devices may be mounted flush with a vertical surface in an upright gaming machine and may be mounted flush or at a slight angle upward with a horizontal in a flat top gaming machine.

The gaming activity player tracking unit 25 communicates with the player tracking server via the SMIB 40, a main communication board 47 and the DCU 37. The SMIB 40 allows the player tracking unit 25 to gather information from the gaming machine 31 such as an amount a player has wagered during a game play session. This information may be used by the player tracking server 30 to calculate player tracking points for the player. The gaming activity player tracking unit 25 is usually connected to the master gaming controller 48 via a serial connection using a wire serial connector and communicates with the master gaming controller 48 using a serial communication protocol. The serial connection between the SMIB 40 and the master gaming controller 48 may be through the main communication board 47, through another intermediate device or through a direct connection to the master gaming controller 48. In general, communication between the various gaming devices is provided using wire connectors with proprietary communication protocols. As an example of a proprietary serial communication protocol, the master gaming controller 48 may employ a subset of the Slot Accounting System (SAS protocol) developed by International Game Technology of Reno, Nev. to communicate with the player tracking unit 25.

In one particular embodiment, by way of example, when a game player desires to play a game on a gaming machine and utilize the gaming activity component of player tracking system 20 available through the player tracking unit, a game player inserts their issued player tracking identification device 23, such as a magnetic striped card, into the card reader 43. Briefly, for current player tracking programs, the most common approach for providing identification information is to issue a magnetic-striped card storing the necessary identification information to each player that wishes to participate in a given player tracking program. It will be appreciated, however, as will be better described below, that the issued player tracking identification device 23 may be wireless interfaces such as Radio Frequency (RF) enabled smart cards and/or wireless Personal Digital Assistants (PDA) which enable wireless communication with the player tracking server. Accordingly, wireless communication may be provided for both the gaming activity player tracking unit 25 and the non-gaming player tracking unit 27.

After the magnetic striped or smart card has been so inserted, the gaming activity player tracking unit 25 may detect this event and receive certain identification information contained on the card. For example, a player's name, address, social security number and player tracking account number encoded on the magnetic striped card, may be received by the player tracking unit 25. In general, a player must provide identification information of some type to utilize player tracking services available on a gaming machine.

Once the player has inserted her or his player tracking card into the gaming activity card reader 43, the player tracking unit 25 may command the touch screen display 46 to display the game player's name on the touch screen display 46 and also, may optionally display a message requesting the game player to validate their identity by entering an identification PIN code using a game service interface with an alpha-numeric key pad displayed on touch screen display 46 or through a player tracking input keypad. For example, the player may use their finger, a stylus or combinations thereof to enter their identification information using the touch screen sensor. Once the game player's identity has been validated, the player tracking information is relayed to the player tracking server 30. Typically, the player tracking server 30 stores player tracking account records including the number of player tracking points previously accumulated by the player. Using this gaming activity data, the casino establishment may monitor their gaming activity for future promotions and customer service. Some player tracking systems, for example, incorporate management programs which update and calculate theoretical win profiles for each respective customer. These profiles are generally a function of estimated winnings from the betting activity of the customer at the casino establishment over a time period.

Details of player tracking units with peripheral devices operated by a master gaming controller are described in co-pending U.S. patent application Ser. No. 09/838,033, filed Apr. 19, 2001, by Criss-Puskiewicz, et al, titled "Univeral Player Tracking System," which is incorporated herein in its entirety and for all purposes and co-pending U.S. patent application Ser. No. 09/642,192, filed Aug. 18, 2000, by LeMay, et al, titled "Gaming Machine Virtual Player Tracking Services," which is incorporated herein in its entirety and for all purposes. Moreover, details of player tracking systems with wireless player tracking identification devices are described in co-pending U.S. patent application Ser. No.: 09/921,489, filed Aug. 3, 2001, by Hedrick, et al, titled "Player Tracking Communication Mechanisms in a Gaming Machine" which is incorporated herein in its entirety and for all purposes.

With respect to the non-gaming player tracking unit 27 (FIG. 2), wireless communication is necessary to maintain any ability to monitor patron movement throughout the non-gaming sections 22 of the casino establishment without inconveniencing the customer. Thus, the non-gaming activity player tracking unit 27 of the tracking system includes a wireless interface 49 configured to locally communicate with the respective wireless identification device 23 issued to that customer. In this manner, movement of the patron can be detected and tracked in the selected non-gaming sections of the casino establishment without requiring a manual input device in the that section. By placing the wireless interfaces at or in the vicinity of the entrances and exits of the selected non-gaming section, the entry into and exit, as well as the time of entry and exit from that non-gaming section can be monitored.

The wireless interface 49, therefore, may be applied to detect or communicate with the identification device 23 carried by the player. These wireless identification devices 23, as mentioned, maybe provided by a Radio Frequency (RF) enabled smart card 50, which has a footprint about the size of a player tracking card, or a portable wireless device, such as a Personal Digital Assistant (PDA) carried or worn by the player. Accordingly, when a patron is in a non-gaming section 22 of the casino, the respective wireless interface 49 may automatically detect the player tracking identification device 23 carried by the player (or they may automatically detect each other) to establish communications allowing presence detection and/or allowing gaming information to be transferred between the wireless devices.

By way of example, the wireless interface 49 may use a wireless communication standard such as Bluetooth™ to communicate with portable wireless devices using the same standard. It will be appreciated, however, that other wireless communication protocols such as IEEE 802.11a, IEEE 802.11b, IEEE 802.11x (e.g. other IEE802.11 standards), hiperlan/2, and HomeRF may also be used. Bluetooth devices communicate on a frequency of 2.45 Gigahertz. Typically, Bluetooth devices send out signals in the range of 1 milliwatt. The signal strength limits the range of the devices to about 10 meters and also limits potential interference sources. Interference is also limited by using spread-spectrum frequency hopping. For instance, a device may use seventy-nine (79) or more randomly chosen frequencies within a designated range that change on a regular basis up to 1,600 times a second. Thus, even if interference occurs, it is likely only to occur for a short period of time.

When Bluetooth-capable devices come within range of one another, an electronic conversation commences to determine whether they have data share or whether one needs to control the other. The connection process is performed automatically. Once a conversation between the devices has occurred, the devices form a network. Bluetooth systems create a Personal-Area Networks (PAN) or "piconets". While the two or more devices in a piconet remain in range of one another, the distances between the communications devices may vary as the wireless devices are, moved about. Once a piconet is established, such as between the wireless interface 49 and a portable wireless device, the members of the piconet randomly hop frequencies in unison so they remain in touch with another and avoid other piconets that may be operating in proximity to the established piconet. When Bluetooth is applied in a casino environment, many such piconets may be operating simultaneously. Details of the Bluetooth™ standard and the Bluetooth™ special interest group may be found at www.bluetooth.com.

The wireless interfaces 49, therefore, should only be capable of local detection of the player tracking identification devices 23 so that the wireless player tracking units at adjacent non-gaming sections, or even the same section, will not improperly detect the presence of the patron. Preferably, such localized detection should be within the range of about 0.0 feet to about 10.0 feet, and more preferably in the range of about 3.0 feet of the entrances into selected restaurants, shops, bars, nightclubs, theaters or any other strategic locations throughout the casino establishment 26.

There are several conventional types of wireless technologies which may be applied for wireless identification devices. For example, these include the Radio Frequency Identification (RFID) Systems such as the Ti-FRID systems provided by Texas Instruments Incorporated of Dallas, Tex., and the contactless smart cards by Fargo Electronics, Inc. of Eden Prairie, Minn.

Figure 3:
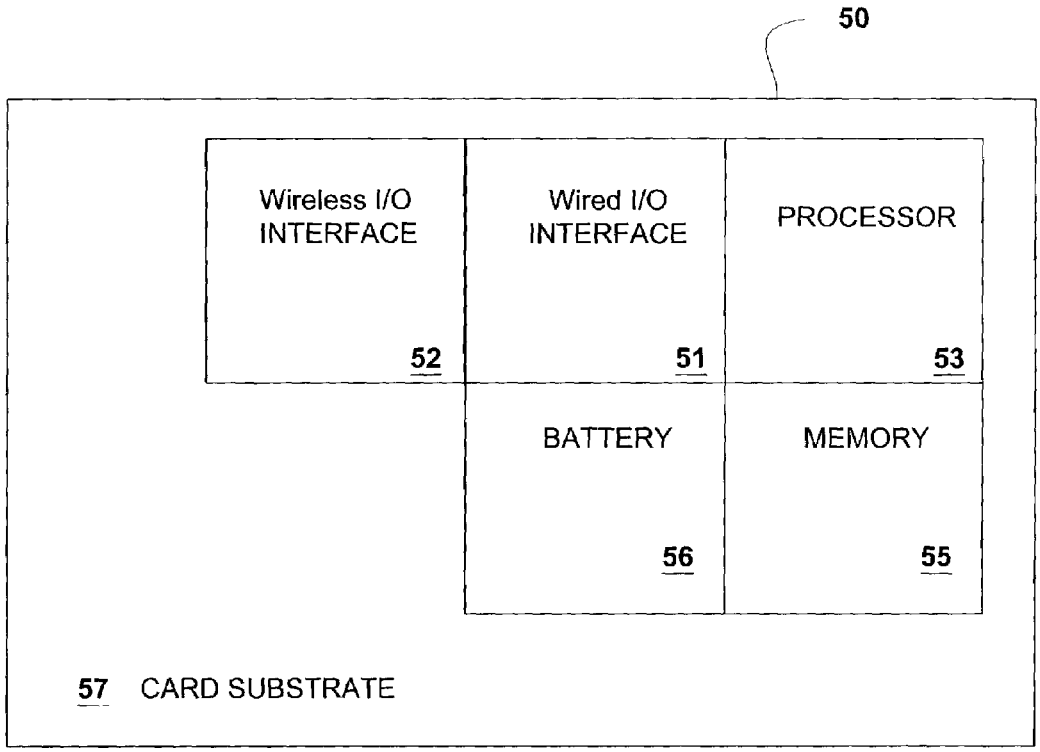
FIG. 3 is a block diagram of the components of a Radio Frequency enabled smart card.

As mentioned, one particularly suitable technology is a Radio Frequency (RF) enabled smart card which can be applied in both the gaming activity tracking unit 25, and the non-gaming tracking unit 27. For instance, FIG. 3 illustrates a block diagram of the components of a smart card 50 that may be used in the present invention. The RF enabled smart card may be designed for wired or wireless use with a gaming machine, gaming peripheral, gaming terminal or some other gaming device, or use with the wireless interface 49 of the tracking unit 27 situated in the non-gaming section 22 of the casino. The smart card 50 which preferably has the same footprint as a magnetic striped card and may include a wired input/output interface 51, a wireless input/output interface 52, a processor 53, memory 55 and a battery 56 incorporated in some manner on a card substrate 57. The battery 56 is used to supply power to operate the devices on the smart card 50. In some embodiments, when it is inserted into a smart card reader of some type, power may also be supplied to the card by the smart card reader.

The smart card 50 may include an operating system of some type that is used to run applications on the smart card. In some embodiments, the operating system for the smart card 50 may be provided by Microsoft (Redmond, Wash.) or Sun Microsystems of Palo Alto, Calif. The operating system may be used to manage the execution of gaming applications on the smart card. The operating system and gaming applications may incorporated into the processor 53 as firmware, stored in the memory 55 on the smart card or may be implemented as a combination of firmware in the processor 53 and stored in the memory 55. The processor 53 may be a general purpose microprocessor or a custom microcontroller incorporating gaming specific firmware. The memory 55 may be flash memory.

The wired Input/output interface 51 may be an I/O EEPROM or the like that allows the smart card 50 to communicate with a smart card reader, such as card reader 43 in FIG. 2. Further, the I/O interface 51 may include one or more communication protocols that allow the smart card 50 to communicate directly with a gaming machine, gaming peripheral, gaming terminal or some other gaming device designed to communicate with the smart card. Some communication protocols may be stored in the memory 55 of the smart card 50. The communication protocols stored in the memory 55 may be added or deleted from the smart card 50 as needed.

In contrast, the wireless Input/output or Input interfaces 49, 36 may be provided by a wireless smart card reader 58 which permits the smart card 50 to communicate with the non-gaming activity player tracking unit 27, and/or the gaming activity player tracking unit 25 residing on a gaming machine, a gaming peripheral, a gaming terminal or some other gaming device designed to communicate with the smart card. This wireless I/O interface 49, 36 may include one or more wireless communication protocols, such as the wireless communication standard Bluetooth™ described above, that allow the smart card 50 to communicate with the corresponding wireless smart card reader 58. Some communication protocols may be stored in the memory 55 of the smart card 50, and may be added or deleted from the smart card 50 as needed.

In accordance with the present invention, the wireless smart card readers 58 of non-gaming activity player tracking units 27 are preferably provided by strategically positioned around the casino establishment to track and monitor movement of the player tracking participating customers. In particular, for casino non-gaming sections 22 such as restaurants, shops, theaters, bars or showrooms, the wireless smart card readers 58 are positioned proximate the entrances and/or exits into and out of the respective sections. Similar to department store security devices, these localized radio receivers may include two cooperating detector devices adapted for placement on opposed sides of each entrance/exit. When a patron carrying an RF enabled smart cards passes between the opposed detectors, their entrance/exit from the non-gaming section can be recorded.

In the present invention, the functions of the smart card, described above, may be performed by other wireless gaming devices. For instance, a player may carry a personal digital assistant (PDA) that executes gaming applications, and may communicate with the non-gaming activity player tracking unit 27 or gaming activity player tracking unit at the gaming machine via a wireless communication interface. One example of a PDA that may be adapted for use with the present invention is the Palm VII from Palm, Inc., Santa Clara, Calif.

Although the foregoing invention has been described in some detail for purposes of clarity of understanding, it will be apparent that certain changes and modifications may be practiced within the scope of the appended claims. For instance, while the gaming machines of this invention have been depicted as upright models having top box mounted on top of the main gaming machine cabinet, the use of gaming devices in accordance with this invention is not so limited. For example, gaming machine may be provided without a top box or the gaming machine may be of a slant-top or table top design.

What is claimed is:

1. A system for tracking customer activity, using player tracking media issued to respective customers that include respective customer IDs which are associated with respective customer accounts, at a casino establishment having gaming sections and non-gaming sections, said system comprising:

at least one gaming activity player tracking unit in the gaming section of the casino establishment which cooperates with the player tracking media to monitor the gaming activity data of the respective customer; and at least one passive non-gaming activity player tracking unit in selected non-gaming sections of the casino establishment which cooperates with the player tracking media to passively monitor an entrance time and exit time of the respective customers into and from respective non-gaming sections when moving about the casino establishment, free of any active recognition event thereof by the respective customers, the entrance time and exit time of which are applied to monitor the respective customers' tendencies to shop and/or visit the selected non-gaming sections so that promotional awards can be customized for the respective customer based upon their past attendance at the respective non-gaming sections, said non-gaming activity player tracking unit including a wireless interface capable of non-biometric passive detection, from a relatively distant range, the presence of a respective player tracking media in the local vicinity of the respective non-gaming section of the casino establishment.

2. The system of claim 1, wherein said non-gaming activity player tracking unit is configured for placement proximate an opening into the respective non-gaming section to detect at least one of an entrance and an exit of the respective customer into and out of the respective non-gaming section.

3. The system of claim 2, wherein said wireless interface is a Radio Frequency (RF) receiver.

4. The system of claim 1, wherein said non-gaming activity includes the tracking of patron movement in said casino establishment.

5. The system of claim 1, further including:

a computer system having a database of the respective customer accounts associated with respective customer Ids, and each said at least one gaming activity player tracking unit and the at least one non-gaming activity player tracking unit coupled to the computer system to generate the respective promotional award for each respective customer.

6. The system of claim 1, wherein said relatively distant range is determined by a wireless communication protocol selected from one of the group consisting of IEEE 802.11a, IEEE 802.11b, IEEE 802.11x, hiperlan/2, HomeRF, and Bluetooth.

7. A player tracking system for tracking customer activities at a casino establishment having gaming sections and non-gaming sections, said system comprising:

at least one processor;

memory;

at least one interface for communicating with at least one other device in the casino establishment;

a first player tracking media for distribution to a participating first customer, the first player tracking media having associated therewith a first customer ID, the first customer ID being associated with a first account relating to the first customer;

a first gaming activity player tracking unit positioned in a first gaming section of the casino establishment and operable to cooperate with the first player tracking media to monitor the gaming activity data associated with the first customer; and a first passive non-gaming activity player tracking unit positioned in a first non-gaming section of the casino establishment and operable to cooperate with the first player tracking media to passively track information relating to at least one event associated with the first customer, wherein the at least one event includes at least one event selected from a group consisting of: an entrance time of the first customer into the first non-gaming section, and an exit time of the first customer from the first non-gaming section;

wherein the passive tracking of information relating to the first customer is based upon at least one event relating to an activity of the first customer which does not include the first customer actively providing input to an electronic device located within the first non-gaming section when moving about the casino establishment;

wherein the first non-gaming activity player tracking unit includes a first wireless interface operable to perform non-biometric passive detection of a presence of the first player tracking media within a specified vicinity of the first non-gaming section; and wherein the player tracking system is operable to generate first customer tracking information using at least a portion of the passively tracked information relating to the first customer;

wherein the first customer tracking information includes at least a portion of information selected from information consisting of: information relating to shopping activity associated with the first customer, and information relating to visitation of the first non-gaming section by the first customer; and wherein the player tracking system is operable to generate at least one customized promotional award for the first customer based on at least a portion of the first customer tracking information.

8. The system of claim 7, wherein said non-gaming activity player tracking unit is configured for placement proximate the entrances and exits of selected, respective non-gaming sections of the casino establishment to detect at least one of an entrance exit of the respective customer into and out of the respective non-gaming section.

9. The system of claim 8, wherein said non-gaming sections include one or more of the following: a casino restaurant, a casino shop, a casino theater, a casino bar and a casino showroom.

10. The system of claim 9, wherein said database includes a management program to update the patron movement of the respective customers in said casino establishment over a time period.

11. The system of claim 7, wherein said respective player tracking media is a Radio Frequency (RF) enabled smart card configured to generate an RF signal, and said wireless interface is a Radio Frequency (RF) receiver responsive to said RF signal.

12. The system of claim 7, wherein said relatively distant range is determined by a wireless communication protocol selected from one of the group consisting of IEEE 802.11a, IEEE 802.11b, IEEE 802.11x, hiperlan/2, HomeRF, and Bluetooth.

13. A method for tracking customer activity, using player tracking media for distribution to a participating first customer, the first player tracking media having associated therewith a first customer TD that, in turn, is associated with a first account relating to the first customer, at a casino establishment having gaming sections and non-gaming sections , said method comprising:

monitoring the gaming activity data associated with the first customer through their player tracking media by a first gaming activity player tracking unit positioned in the gaming section of the casino establishment;

passively tracking information relating to at least one non-gaming event associated with the first customer through their player tracking media by a first non-gaming activity player tracking unit positioned in the non-gaming section of the casino establishment; said at least one event includes at least one event selected from a group consisting of: an entrance time of the first customer into the first non-gaming section, and an exit time of the first customer from the first non-gaming section, said passively tracking information associated with the first customer is based upon an activity of the first customer which does not include the first customer actively providing input to an electronic device located within the first non-gaming section when moving about the casino establishment, said first non-gaming activity player tracking unit further includes a first wireless interface operable to perform non- biometric passive detection of a presence of the first player tracking media within a specified vicinity of the first non-gaming section;

generating first customer tracking information using at least a portion of the passively tracked information relating to the first customer, said first customer tracking information includes at least a portion of information selected from information consisting of: information relating to shopping activity associated with the first customer, and information relating to visitation of the first non-gaming section by the first customer; and customizing at least one promotional award for the first customer based on at least a portion of the first customer tracking information.

14. The method of claim 13, wherein said respective player tracking media is a Radio Frequency (RF) enabled smart card configured to generate an RF signal, and said wireless interface is a Radio Frequency (RF) receiver responsive to said RF signal.

15. The method of claim 13, further including:

placing the non-gaming activity player tracking unit proximate one of an entrance and an exit of a selected, respective non-gaming section of the casino establishment to detect one of the entrance time and the exit time of the respective customer into and out of the respective non-gaming section.

16. The method of claim 15, wherein said non-gaming section includes one of the following: a casino restaurant, a casino shop, a casino theater, a casino bar and a casino showroom.

17. The method of claim 15, further including:

tracking patron movement of the respective customers in the non-gaming sections of the casino establishment through the non-gaming activity data.

18. The method of claim 17, wherein periodically updating the patron movement of the respective customers in said casino establishment over a time period.

19. The method of claim 13, wherein said monitoring of the gaming activity data includes reading the customer identity information from the respective player tracking media through a reader device.

20. The method of claim 13, wherein said relatively distant range is determined by a wireless communication protocol selected from one of the group consisting of IEEE 802.11a, IEEE 802.11b, IEEE 802.11x, hiperlan/2, HomeRF, and Bluetooth.

* * * * *